US008091534B2

(12) United States Patent
Mineo

(10) Patent No.: US 8,091,534 B2
(45) Date of Patent: Jan. 10, 2012

(54) INSTALLATION STRUCTURE FOR COMPRESSOR

(75) Inventor: Shigeharu Mineo, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 265 days.

(21) Appl. No.: 11/527,189

(22) Filed: Sep. 26, 2006

(65) Prior Publication Data

US 2007/0079796 A1 Apr. 12, 2007

(30) Foreign Application Priority Data

Sep. 26, 2005 (JP) ..... 2005-277287

(51) Int. Cl.

| | |
|---|---|
| ***F02B 33/00*** | (2006.01) |
| ***B63H 20/14*** | (2006.01) |
| ***B63H 23/00*** | (2006.01) |
| ***B63H 23/34*** | (2006.01) |
| ***B63H 21/00*** | (2006.01) |

(52) U.S. Cl. ..... 123/559.1; 123/559.3; 440/75; 440/83; 440/89 R

(58) Field of Classification Search ..... 123/559.1, 123/559.3; 440/75, 83, 89 R
See application file for complete search history.

(56) References Cited

U.S. PATENT DOCUMENTS

| | | | | |
|---|---|---|---|---|
| 1,871,662 A | | 8/1932 | Carrier | |
| 1,876,948 A | | 9/1932 | Jahnke | |
| 1,903,210 A | | 3/1933 | Carrier | |
| 1,951,045 A | * | 3/1934 | Willgoos | 123/559.3 |
| 1,974,974 A | | 9/1934 | Puffer | |
| 2,098,718 A | * | 11/1937 | Caminez et al. | 123/559.1 |
| 2,151,075 A | | 3/1939 | Berger | |
| 2,223,715 A | | 12/1940 | Berger | |
| 2,344,366 A | | 3/1944 | Prince | |
| 2,354,227 A | * | 7/1944 | Szekely | 123/54.7 |
| 2,366,365 A | | 1/1945 | Sorensen | |
| 2,378,452 A | | 6/1945 | Vincent | |
| 2,406,388 A | | 8/1946 | Larrecq | |
| 2,455,678 A | | 12/1948 | Irving | |
| 2,523,588 A | | 9/1950 | Ormsby | |
| 2,565,060 A | | 8/1951 | Beardsley et al. | |
| 2,695,131 A | * | 11/1954 | Price | 415/122.1 |
| 2,828,907 A | | 4/1958 | Oehrli | |
| 2,847,186 A | | 4/1958 | Anderson et al. | |
| 2,973,894 A | | 3/1961 | Kimball et al. | |
| 3,137,281 A | | 6/1964 | Fulker | |
| 3,418,986 A | * | 12/1968 | Scherenberg | 123/559.1 |
| 3,554,322 A | | 1/1971 | Deutschmann et al. | |

(Continued)

FOREIGN PATENT DOCUMENTS

EP 44348 A1 1/1982

(Continued)

*Primary Examiner* — Thai Ba Trieu
(74) *Attorney, Agent, or Firm* — Keating & Bennett, LLP

(57) ABSTRACT

An engine is provided to facilitate installation of a compressor on an engine. The engine can include a crankshaft, a front end, and an installation structure, and can be disposed in an engine compartment having an opening for accessing the engine. The installation structure can comprise an installation mount that can be disposed at the front end of the engine. The installation mount can extend substantially parallel to the crankshaft of the engine. The installation mount can include a surface configured for mounting the compressor. Further, the installation mount can be configured with the surface thereof facing toward the opening of the engine compartment. Additionally, the installation structure can be configured to facilitate meshing engagement of the crankshaft with a drive shaft of the compressor.

21 Claims, 7 Drawing Sheets

U.S. PATENT DOCUMENTS

| | | | | |
|---|---|---|---|---|
| 3,703,877 | A | | 11/1972 | Ueda |
| 3,995,603 | A | | 12/1976 | Thien et al. |
| 4,010,717 | A | | 3/1977 | Taplin |
| 4,035,171 | A | | 7/1977 | Reed et al. |
| 4,068,612 | A | | 1/1978 | Meiners |
| 4,198,217 | A | | 4/1980 | Erdmannsdorfer |
| 4,212,659 | A | | 7/1980 | Magrini |
| 4,267,811 | A | | 5/1981 | Springer |
| 4,285,632 | A | | 8/1981 | DeSalve |
| 4,300,488 | A | | 11/1981 | Cser |
| 4,319,657 | A | | 3/1982 | Nomura |
| 4,321,896 | A | | 3/1982 | Kasting |
| 4,326,374 | A | | 4/1982 | Streb |
| 4,353,211 | A | | 10/1982 | Cser et al. |
| 4,412,520 | A | | 11/1983 | Mitsuyasu et al. |
| 4,422,295 | A | | 12/1983 | Minami et al. |
| 4,445,337 | A | * | 5/1984 | McCreary ..... 60/608 |
| 4,459,808 | A | | 7/1984 | Rydquist et al. |
| 4,475,617 | A | | 10/1984 | Minami et al. |
| 4,496,019 | A | | 1/1985 | Tanaka |
| 4,512,152 | A | | 4/1985 | Asaba |
| 4,513,725 | A | | 4/1985 | Minami et al. |
| RE31,877 | E | | 5/1985 | Nomura |
| 4,519,373 | A | | 5/1985 | Hardy et al. |
| 4,538,556 | A | | 9/1985 | Takeda |
| 4,553,515 | A | | 11/1985 | King et al. |
| 4,562,697 | A | | 1/1986 | Lawson |
| 4,630,446 | A | | 12/1986 | Iwai et al. |
| 4,633,826 | A | | 1/1987 | Tominaga et al. |
| 4,662,323 | A | | 5/1987 | Moriya |
| 4,674,457 | A | | 6/1987 | Berger et al. |
| 4,677,826 | A | | 7/1987 | Iwai et al. |
| 4,678,441 | A | | 7/1987 | Murase |
| 4,702,219 | A | | 10/1987 | Tadokoro et al. |
| 4,709,682 | A | | 12/1987 | Kato |
| 4,712,517 | A | | 12/1987 | Anno et al. |
| 4,718,396 | A | | 1/1988 | Shimada et al. |
| 4,723,526 | A | | 2/1988 | Horiuchi et al. |
| 4,733,361 | A | | 3/1988 | Krieser et al. |
| 4,738,229 | A | | 4/1988 | Wada et al. |
| 4,741,302 | A | | 5/1988 | Oda et al. |
| 4,760,703 | A | | 8/1988 | Minami et al. |
| 4,781,553 | A | | 11/1988 | Nomura et al. |
| 4,796,574 | A | | 1/1989 | Fujii et al. |
| 4,797,068 | A | | 1/1989 | Hayakawa et al. |
| 4,827,722 | A | | 5/1989 | Torigai |
| 4,848,170 | A | | 7/1989 | Inagaki et al. |
| 4,887,692 | A | | 12/1989 | Outani et al. |
| 4,896,734 | A | | 1/1990 | Horiuchi et al. |
| 4,900,343 | A | | 2/1990 | Minami et al. |
| 4,936,278 | A | | 6/1990 | Umeda |
| 4,938,664 | A | | 7/1990 | Zinsmeyer |
| 4,955,352 | A | | 9/1990 | Takeda |
| 4,972,807 | A | | 11/1990 | Morishita |
| 4,982,682 | A | | 1/1991 | Hattori |
| 4,984,528 | A | | 1/1991 | Kobayashi |
| 4,984,974 | A | | 1/1991 | Naya et al. |
| 4,989,409 | A | | 2/1991 | Nakase et al. |
| 4,991,532 | A | | 2/1991 | Locke |
| 5,002,021 | A | | 3/1991 | Nakata et al. |
| 5,009,204 | A | | 4/1991 | Ishii |
| 5,014,816 | A | | 5/1991 | Dear et al. |
| 5,031,591 | A | | 7/1991 | Shinoda et al. |
| 5,060,622 | A | * | 10/1991 | Suzuki ..... 123/559.1 |
| 5,088,280 | A | | 2/1992 | Scott-Scott et al. |
| 5,094,193 | A | | 3/1992 | Yoshikawa |
| 5,095,859 | A | | 3/1992 | Iwata et al. |
| 5,119,795 | A | | 6/1992 | Goto et al. |
| 5,130,014 | A | | 7/1992 | Volz |
| 5,133,307 | A | | 7/1992 | Kurihara |
| 5,136,547 | A | | 8/1992 | Laukien |
| 5,136,993 | A | | 8/1992 | Ampferer et al. |
| 5,143,028 | A | | 9/1992 | Takahashi |
| 5,158,427 | A | | 10/1992 | Shirai |
| 5,159,903 | A | | 11/1992 | Takahashi |
| 5,163,811 | A | | 11/1992 | Okada |
| RE34,226 | E | | 4/1993 | Morishita |
| 5,215,164 | A | | 6/1993 | Shibata |
| 5,230,320 | A | | 7/1993 | Hitomi et al. |
| 5,239,950 | A | | 8/1993 | Takahashi |
| 5,243,945 | A | | 9/1993 | Katoh et al. |
| 5,253,618 | A | | 10/1993 | Takahashi et al. |
| 5,261,356 | A | | 11/1993 | Takahashi et al. |
| 5,293,846 | A | | 3/1994 | Takahashi |
| 5,299,423 | A | | 4/1994 | Shiozawa et al. |
| 5,330,374 | A | | 7/1994 | Ishino |
| 5,334,063 | A | | 8/1994 | Inoue et al. |
| 5,340,343 | A | | 8/1994 | Kawamukai et al. |
| 5,340,344 | A | | 8/1994 | Mineo et al. |
| 5,357,913 | A | | 10/1994 | Okumura et al. |
| 5,365,908 | A | | 11/1994 | Takii et al. |
| 5,377,629 | A | | 1/1995 | Brackett et al. |
| 5,377,634 | A | | 1/1995 | Taue |
| 5,389,022 | A | | 2/1995 | Kobayashi |
| 5,390,621 | A | | 2/1995 | Hattori et al. |
| RE34,922 | E | | 5/1995 | Hattori et al. |
| 5,427,079 | A | | 6/1995 | Andrepont et al. |
| 5,438,946 | A | | 8/1995 | Kobayashi |
| 5,456,230 | A | | 10/1995 | Van Rens et al. |
| 5,476,402 | A | | 12/1995 | Nakai et al. |
| 5,477,838 | A | | 12/1995 | Schlunke et al. |
| 5,503,117 | A | | 4/1996 | Saito |
| 5,513,606 | A | | 5/1996 | Shibata |
| 5,529,027 | A | | 6/1996 | Okubo |
| 5,537,968 | A | | 7/1996 | Takahashi |
| 5,558,549 | A | | 9/1996 | Nakase et al. |
| 5,584,733 | A | | 12/1996 | Kobayashi |
| 5,586,922 | A | | 12/1996 | Kobayashi et al. |
| 5,603,301 | A | | 2/1997 | Sakurai et al. |
| 5,619,950 | A | | 4/1997 | Ikeda |
| 5,632,239 | A | | 5/1997 | Patyi et al. |
| 5,634,422 | A | | 6/1997 | Kobayashi et al. |
| 5,636,586 | A | | 6/1997 | Suganuma |
| 5,638,796 | A | | 6/1997 | Adams, III et al. |
| 5,647,779 | A | | 7/1997 | Nanami |
| 5,660,115 | A | | 8/1997 | Taue et al. |
| 5,660,571 | A | | 8/1997 | Nakayasu et al. |
| 5,664,515 | A | | 9/1997 | Hattori et al. |
| 5,671,703 | A | | 9/1997 | Otome et al. |
| 5,678,525 | A | | 10/1997 | Taue |
| 5,682,870 | A | | 11/1997 | Motoyama |
| 5,699,749 | A | | 12/1997 | Yamada et al. |
| 5,709,185 | A | | 1/1998 | Aizawa et al. |
| 5,709,186 | A | | 1/1998 | Taue |
| 5,709,198 | A | | 1/1998 | Sagisaka et al. |
| 5,743,206 | A | | 4/1998 | Hattori |
| 5,746,270 | A | | 5/1998 | Schroeder et al. |
| 5,755,194 | A | | 5/1998 | Moorman et al. |
| 5,755,283 | A | | 5/1998 | Yates et al. |
| 5,769,039 | A | | 6/1998 | Taue et al. |
| 5,778,833 | A | | 7/1998 | Kuranishi |
| 5,778,838 | A | | 7/1998 | Taue |
| 5,778,857 | A | | 7/1998 | Nakamura et al. |
| 5,779,451 | A | | 7/1998 | Hatton |
| 5,797,778 | A | | 8/1998 | Ito et al. |
| 5,813,888 | A | | 9/1998 | Ozawa |
| 5,820,426 | A | | 10/1998 | Hale |
| 5,827,096 | A | | 10/1998 | Mineo |
| 5,829,402 | A | | 11/1998 | Takahashi et al. |
| 5,830,021 | A | | 11/1998 | Takahashi et al. |
| 5,839,930 | A | | 11/1998 | Nanami et al. |
| 5,845,618 | A | | 12/1998 | Taue et al. |
| 5,846,102 | A | | 12/1998 | Nitta et al. |
| 5,855,193 | A | | 1/1999 | Takahashi |
| 5,871,340 | A | | 2/1999 | Hatton |
| 5,871,380 | A | | 2/1999 | Claussen |
| 5,899,778 | A | | 5/1999 | Hiraoka et al. |
| 5,902,161 | A | | 5/1999 | Nakase |
| 5,906,083 | A | | 5/1999 | Olsen et al. |
| 5,908,337 | A | | 6/1999 | Mashiko |
| 5,911,211 | A | | 6/1999 | Uchida |
| 5,928,044 | A | | 7/1999 | Mineo |
| 5,934,070 | A | | 8/1999 | Lagelstorfer |
| 5,937,818 | A | | 8/1999 | Kawai et al. |
| 5,937,825 | A | | 8/1999 | Motose |
| 5,941,223 | A | | 8/1999 | Kato |
| 5,951,343 | A | | 9/1999 | Nanami et al. |

| | | | | |
|---|---|---|---|---|
| 5,957,072 | A | 9/1999 | Hattori | |
| 5,957,112 | A | 9/1999 | Takahashi et al. | |
| 5,960,770 | A | 10/1999 | Taue et al. | |
| 5,983,878 | A | 11/1999 | Nonaka et al. | |
| 6,006,540 | A | 12/1999 | Coletti | |
| 6,009,705 | A | 1/2000 | Arnott et al. | |
| 6,015,320 | A | 1/2000 | Nanami | |
| 6,015,321 | A | 1/2000 | Ozawa et al. | |
| 6,016,782 | A | 1/2000 | Henmi | |
| 6,022,252 | A | 2/2000 | Ozawa | |
| 6,026,775 | A | 2/2000 | Yamane | |
| 6,029,638 | A | 2/2000 | Funai et al. | |
| 6,041,758 | A | 3/2000 | Ishii | |
| 6,055,959 | A | 5/2000 | Taue | |
| 6,079,378 | A | 6/2000 | Taue et al. | |
| 6,085,702 | A | 7/2000 | Ito | |
| 6,099,371 | A | 8/2000 | Nozawa et al. | |
| 6,142,842 | A | 11/2000 | Watanabe et al. | |
| 6,149,477 | A | 11/2000 | Toyama | |
| 6,171,380 | B1 | 1/2001 | Wood et al. | |
| 6,192,871 | B1 * | 2/2001 | Middlebrook | 123/559.1 |
| 6,205,987 | B1 | 3/2001 | Shigedomi et al. | |
| 6,213,062 | B1 | 4/2001 | Kawase | |
| 6,263,851 | B1 | 7/2001 | Henmi | |
| 6,269,797 | B1 | 8/2001 | Uchida | |
| 6,279,372 | B1 | 8/2001 | Zhang | |
| 6,286,492 | B1 | 9/2001 | Kanno | |
| 6,302,752 | B1 | 10/2001 | Ito et al. | |
| 6,312,299 | B1 | 11/2001 | Henmi | |
| 6,318,085 | B1 | 11/2001 | Torno et al. | |
| 6,390,869 | B2 | 5/2002 | Korenjak et al. | |
| 6,394,060 | B2 | 5/2002 | Nagai et al. | |
| 6,394,777 | B2 | 5/2002 | Haavik | |
| 6,415,759 | B2 | 7/2002 | Ohrnberger et al. | |
| 6,447,351 | B1 | 9/2002 | Nanami | |
| 6,453,890 | B1 | 9/2002 | Kageyama et al. | |
| 6,497,596 | B1 | 12/2002 | Nanami | |
| 6,516,789 | B1 * | 2/2003 | Jones | 123/559.1 |
| 6,517,397 | B1 | 2/2003 | Gohara et al. | |
| 6,544,086 | B2 | 4/2003 | Tscherne et al. | |
| 6,568,376 | B2 * | 5/2003 | Sonnleitner et al. | 123/559.1 |
| 6,578,508 | B2 | 6/2003 | Hattori et al. | |
| 6,591,819 | B2 | 7/2003 | Tscherne et al. | |
| 6,601,528 | B2 | 8/2003 | Bilek et al. | |
| 6,623,321 | B2 | 9/2003 | Ishino | |
| 6,626,140 | B2 | 9/2003 | Aichinger et al. | |
| 6,637,406 | B2 | 10/2003 | Yamada et al. | |
| 6,640,754 | B1 | 11/2003 | Iida | |
| 6,644,942 | B2 | 11/2003 | Rival et al. | |
| 6,651,633 | B1 * | 11/2003 | Jones | 123/559.1 |
| 6,663,366 | B2 | 12/2003 | Okada et al. | |
| 6,672,918 | B2 | 1/2004 | Mashiko et al. | |
| 6,672,919 | B1 | 1/2004 | Beson | |
| 6,746,288 | B2 | 6/2004 | Gokan | |
| 6,769,942 | B2 | 8/2004 | Bourret et al. | |
| 6,793,546 | B2 | 9/2004 | Matsuda | |
| 6,796,126 | B2 | 9/2004 | Hasegawa et al. | |
| 6,810,855 | B2 | 11/2004 | Hasegawa et al. | |
| 6,896,566 | B2 | 5/2005 | Takahashi et al. | |
| 6,935,102 | B2 | 8/2005 | Lindskog | |
| 6,973,985 | B2 | 12/2005 | Yatagai et al. | |
| 7,007,682 | B2 | 3/2006 | Takahashi et al. | |
| 7,101,238 | B2 | 9/2006 | Aichinger et al. | |
| 7,137,376 | B2 * | 11/2006 | Ito | 123/196 R |
| 7,343,906 | B2 * | 3/2008 | Ozawa | 123/559.1 |
| 7,607,958 | B1 * | 10/2009 | Hochmayr et al. | 440/75 |
| 2001/0044352 | A1 | 11/2001 | Korenjak et al. | |
| 2002/0025742 | A1 | 2/2002 | Berthiaume et al. | |
| 2003/0015126 | A1 | 1/2003 | Gokan | |
| 2003/0094162 | A1 * | 5/2003 | Baldwin | 123/533 |
| 2004/0253886 | A1 | 12/2004 | Mashiko | |
| 2005/0172919 | A1 | 8/2005 | Ozaki et al. | |
| 2005/0204730 | A1 * | 9/2005 | Tsukahara et al. | 60/290 |
| 2005/0247498 | A1 | 11/2005 | Pichler et al. | |
| 2005/0268878 | A1 * | 12/2005 | Ito | 123/196 R |
| 2005/0279092 | A1 * | 12/2005 | Ozawa | 60/599 |
| 2005/0279335 | A1 * | 12/2005 | Ozawa | 123/559.1 |
| 2006/0016437 | A1 * | 1/2006 | Ozawa | 123/564 |
| 2006/0054146 | A1 | 3/2006 | Ozawa | |
| 2006/0060170 | A1 | 3/2006 | Ozawa | |
| 2006/0243259 | A1 | 11/2006 | Takahashi | |
| 2007/0059997 | A1 | 3/2007 | Mineo | |
| 2007/0062498 | A1 * | 3/2007 | Woods | 123/559.1 |

FOREIGN PATENT DOCUMENTS

| | | | |
|---|---|---|---|
| EP | 0 500 139 | B1 | 8/1992 |
| FR | 1263608 | | 5/1996 |
| GB | 1389973 | A | 4/1975 |
| JP | 57-062929 | | 4/1982 |
| JP | 57-062930 | | 4/1982 |
| JP | 57-073817 | | 5/1982 |
| JP | 57-073818 | | 5/1982 |
| JP | 57-073820 | | 5/1982 |
| JP | 57-083632 | | 5/1982 |
| JP | 57-093627 | | 6/1982 |
| JP | 57-105537 | | 7/1982 |
| JP | 57-113922 | | 7/1982 |
| JP | 57-113944 | | 7/1982 |
| JP | 57-151019 | | 9/1982 |
| JP | 57-171027 | | 10/1982 |
| JP | 57-181931 | | 11/1982 |
| JP | 57-183512 | | 11/1982 |
| JP | 57-191421 | | 11/1982 |
| JP | 57-203822 | | 12/1982 |
| JP | 58-044221 | | 3/1983 |
| JP | 58-053655 | | 3/1983 |
| JP | 58-057023 | | 4/1983 |
| JP | 58-082038 | | 5/1983 |
| JP | 58-128925 | | 8/1983 |
| JP | 58-170628 | | 10/1983 |
| JP | 58-185927 | | 10/1983 |
| JP | 58-185929 | | 10/1983 |
| JP | 58-185930 | | 10/1983 |
| JP | 58-185931 | | 10/1983 |
| JP | 58-185932 | | 10/1983 |
| JP | 58-192924 | | 11/1983 |
| JP | 58-194695 | | 11/1983 |
| JP | 59-018228 | | 1/1984 |
| JP | 59-053229 | | 3/1984 |
| JP | 59-176419 | | 10/1984 |
| JP | 59-201932 | | 11/1984 |
| JP | 59-220492 | | 12/1984 |
| JP | 60-119328 | | 6/1985 |
| JP | 60-150445 | | 8/1985 |
| JP | 60-240522 | | 11/1985 |
| JP | 60-240523 | | 11/1985 |
| JP | 60-240524 | | 11/1985 |
| JP | 60-240525 | | 11/1985 |
| JP | 61-126324 | | 6/1986 |
| JP | 61-126325 | | 6/1986 |
| JP | 61-215123 | | 9/1986 |
| JP | 61-237824 | | 10/1986 |
| JP | 62-060926 | | 3/1987 |
| JP | 62258130 | | 11/1987 |
| JP | 01-119421 | | 5/1989 |
| JP | 01-182560 | | 7/1989 |
| JP | 01-211615 | | 8/1989 |
| JP | 01-229786 | | 9/1989 |
| JP | 01-232112 | | 9/1989 |
| JP | 01-232113 | | 9/1989 |
| JP | 01-232115 | | 9/1989 |
| JP | 01-232116 | | 9/1989 |
| JP | 01-232118 | | 9/1989 |
| JP | 01-301917 | | 12/1989 |
| JP | 01-301918 | | 12/1989 |
| JP | 01-301919 | | 12/1989 |
| JP | 01-313624 | | 12/1989 |
| JP | 02-006289 | | 1/1990 |
| JP | 02-016327 | | 1/1990 |
| JP | 02-024282 | | 1/1990 |
| JP | 02-024283 | | 1/1990 |
| JP | 02-024284 | | 1/1990 |
| JP | 02-070920 | | 3/1990 |
| JP | 02-119636 | | 5/1990 |
| JP | 02-175491 | | 7/1990 |
| JP | 02-188624 | | 7/1990 |
| JP | 02-201026 | | 8/1990 |
| JP | 02-294520 | | 12/1990 |

| | | |
|---|---|---|
| JP | 03-021584 | 1/1991 |
| JP | 03-023317 | 1/1991 |
| JP | 03-047425 | 2/1991 |
| JP | 03-168352 | 7/1991 |
| JP | 03-179152 | 8/1991 |
| JP | 03-182626 | 8/1991 |
| JP | 03-182635 | 8/1991 |
| JP | 03-260368 | 11/1991 |
| JP | 03-281939 | 12/1991 |
| JP | 04-081325 | 3/1992 |
| JP | 04-183933 | 6/1992 |
| JP | 04-203317 | 7/1992 |
| JP | 07-311626 | 11/1992 |
| JP | 05-141260 | 6/1993 |
| JP | 05-141262 | 6/1993 |
| JP | 05-332188 | 12/1993 |
| JP | 06-093869 | 4/1994 |
| JP | 06-212986 | 8/1994 |
| JP | 07-026946 | 1/1995 |
| JP | 07-091264 | 4/1995 |
| JP | 07-145730 | 6/1995 |
| JP | 07-151006 | 6/1995 |
| JP | 07-317545 | 12/1995 |
| JP | 07-317555 | 12/1995 |
| JP | 07-317556 | 12/1995 |
| JP | 07-317557 | 12/1995 |
| JP | 08-028280 | 1/1996 |
| JP | 08-028285 | 1/1996 |
| JP | 08-104286 | 4/1996 |
| JP | 08-104295 | 4/1996 |
| JP | 08-114122 | 5/1996 |
| JP | 08-114123 | 5/1996 |
| JP | 08-114124 | 5/1996 |
| JP | 08-114125 | 5/1996 |
| JP | 08-151926 | 6/1996 |
| JP | 08-151965 | 6/1996 |
| JP | 08-296449 | 12/1996 |
| JP | 08-319840 | 12/1996 |
| JP | 08-319901 | 12/1996 |
| JP | 09-184426 | 7/1997 |
| JP | 09-287465 | 11/1997 |
| JP | 09-287467 | 11/1997 |
| JP | 09-287470 | 11/1997 |
| JP | 09-287471 | 11/1997 |
| JP | 09-287472 | 11/1997 |
| JP | 09-287475 | 11/1997 |
| JP | 09-287486 | 11/1997 |
| JP | 10-008973 | 1/1998 |
| JP | 10-008974 | 1/1998 |
| JP | 10-089079 | 4/1998 |
| JP | 10-131818 | 5/1998 |
| JP | 10-299525 | 11/1998 |
| JP | 11-099992 | 4/1999 |
| JP | 2000-038968 | 2/2000 |
| JP | 3060489 | 4/2000 |
| JP | 2001-082160 | 3/2001 |
| JP | 2001-098960 | 4/2001 |
| JP | 2001-233276 | 8/2001 |
| JP | 2001-233277 | 8/2001 |
| JP | 2001-263076 | 9/2001 |
| JP | 2001-280144 | 10/2001 |
| JP | 2001-323819 | 11/2001 |
| JP | 2003-027952 | 1/2003 |
| JP | 2003-049654 | 2/2003 |
| JP | 2003-074445 | 3/2003 |
| JP | 2006-083713 | 3/2006 |

* cited by examiner

INSTALLATION STRUCTURE FOR COMPRESSOR

CROSS-REFERENCE TO RELATED APPLICATIONS

The present application is based on and claims priority under 35 U.S.C. §119 to Japanese Patent Application No. 2005-277287, filed on Sep. 26, 2005, the entire contents of which is expressly incorporated by reference herein.

BACKGROUND OF THE INVENTIONS

1. Field of the Inventions

The present inventions relate to an installation structure for a compressor, which compresses and provides air to an engine.

2. Description of the Related Art

Conventionally, small boats, automobiles, personal watercraft and other vehicles are equipped with a compressor which provides air to an engine (see e.g. U.S. Pat. No. 6,568,376). For example, the compressor of a personal watercraft is typically installed on an installation mount located at the front portion of the watercraft's engine.

The installation of the compressor is facilitated by the inclusion of an opening in the body of the personal watercraft. The opening permits access for repairs and inspection of the engine and related parts. The opening is covered by a lid member and is located above the front portion of the engine. Despite the convenience provided by the opening, compressor installation and removal are still very difficult tasks due to the configuration of the engine and related parts.

When installing the compressor on the installation mount of the engine, a tedious and difficult process must be followed. The compressor must first be passed it into the body through the opening. Then the compressor is moved rearward from the front portion of the engine along a crankshaft axis until being positioned adjacent the installation mount. Finally, the compressor is aligned with and placed onto the installation mount. Fasteners such as bolts can be used to secure the compressor to the installation mount parallel to the crankshaft. This procedure can be reversed in order to remove the compressor.

Thus, the installation and removal of the compressor can be very difficult. Additionally, sufficient space within the engine compartment must exist to move the compressor in the direction parallel to the crankshaft. Otherwise, the space for the compressor must be widened.

SUMMARY OF THE INVENTIONS

An aspect of at least one of the embodiments disclosed herein includes the realization that at least one of the difficulties described above with regard to the removal and installation of a compressor can be reduced or eliminated by changing the mounting arrangement for the compressor. For example, the mounting arrangement can be designed to reduce, minimize, or eliminate the need to move the compressor parallel to the crankshaft of the engine after the compressor is inserted through the access opening.

Thus, in accordance with an embodiment, an engine is provided that can be disposed in an engine compartment which includes an opening for accessing the engine. The engine can include a crankshaft, a front end, and an installation structure for a compressor. The engine can comprise an installation mount that can be disposed at the front end of the engine. The installation mount can extend substantially parallel to the crankshaft of the engine. The installation mount can include a surface configured for mounting the compressor. The installation mount can also be configured with the surface thereof facing toward the opening of the engine compartment.

In accordance with another embodiment, a marine engine assembly is provided for a personal watercraft. The assembly can comprise an engine, a compressor, and an installation structure. The engine can include a crankshaft and a front end. The engine can be disposed in an engine compartment of the personal watercraft. The engine compartment can have an opening for accessing the engine.

The compressor can include an impeller, a housing containing the impeller, a drive shaft of the impeller, and a directly-coupled gear train. The directly-coupled gear train can include a drive gear connected to the drive shaft and an intermediate gear meshed with the drive gear and the crankshaft. The installation structure for the compressor can comprise an installation mount and a plurality of screw holes disposed through the installation mount.

The installation mount can extend substantially parallel to the crankshaft of the engine. The installation mount can have a surface and can be disposed at the front end of the engine with the surface facing toward the opening of the engine compartment. The surface can be sized and configured to allow the compressor to be mounted on the surface with the crankshaft of the engine being meshed to the drive shaft of the compressor via the directly-coupled gear train of the compressor so as to transmit driving force to the drive gear. The plurality of screw holes can be oriented perpendicular relative to the surface. Further, the screw holes can be configured to receive bolts for attaching the compressor to the mounting surface.

BRIEF DESCRIPTION OF THE DRAWINGS

The above mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
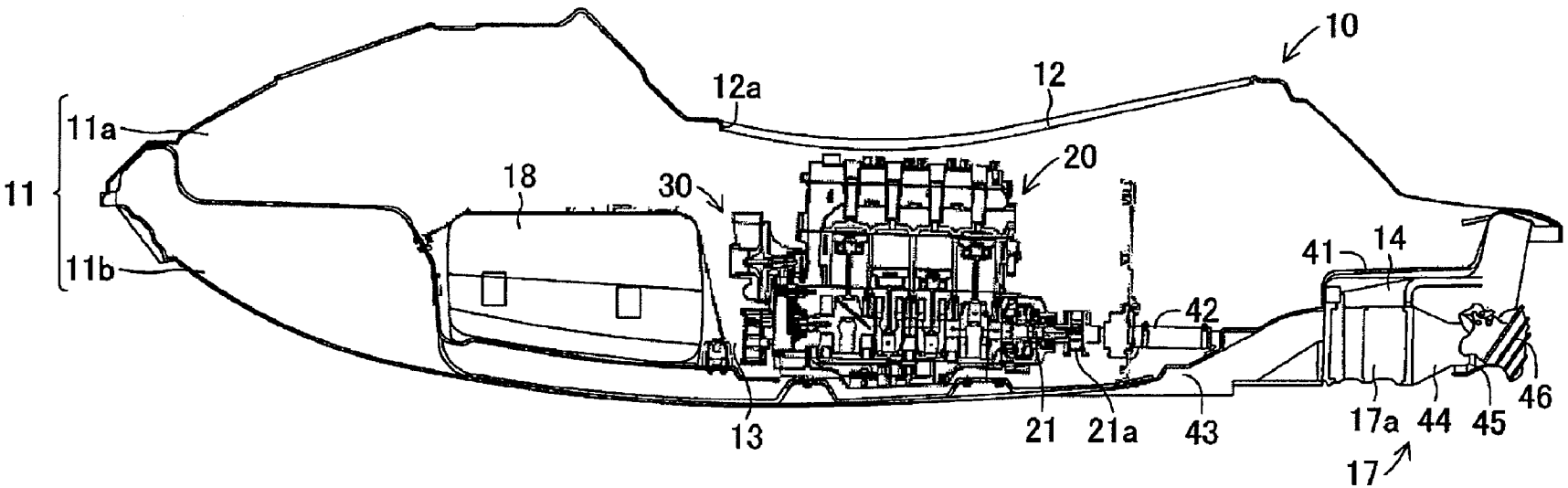
FIG. 1 is a side elevational and partial cutaway view of a personal watercraft having an engine with an installation structure for a compressor, according to an embodiment.

FIGS. 1-7 illustrate an embodiment of an engine and assembly having an installation structure for a compressor. The embodiments disclosed herein are described in the context of a marine propulsion system of a personal watercraft because these embodiments have particular utility in this context. However, the embodiments and inventions herein can also be applied to other marine vessels, boats, such as small jet boats, as well as other land and marine vehicles. It is to be understood that the embodiments disclosed herein are exemplary but non-limiting embodiments, and thus, the inventions disclosed herein are not limited to the disclosed exemplary embodiments.

The personal watercraft 10 can have a body 11 that can include a deck 11*a* and hull 11*b*. Steering handlebars (not shown) can be located slightly ahead of the center on the body 11. A seat 12 can also be provided at about the center of an upper part of the body 11. The seat 12, which can be removable from the deck 11*a*, can be mounted to an opening 12*a* generally at the center of the deck 11*a*.

The inside of the body 11 can be divided into two sections; an engine compartment 13 in the front half of the body 11, and a pump compartment 14 in the rear half thereof. However, the inside of the body 11 can be a single compartment or it can be divided into additional compartments. However, other configurations can also be used.

Figure 2:
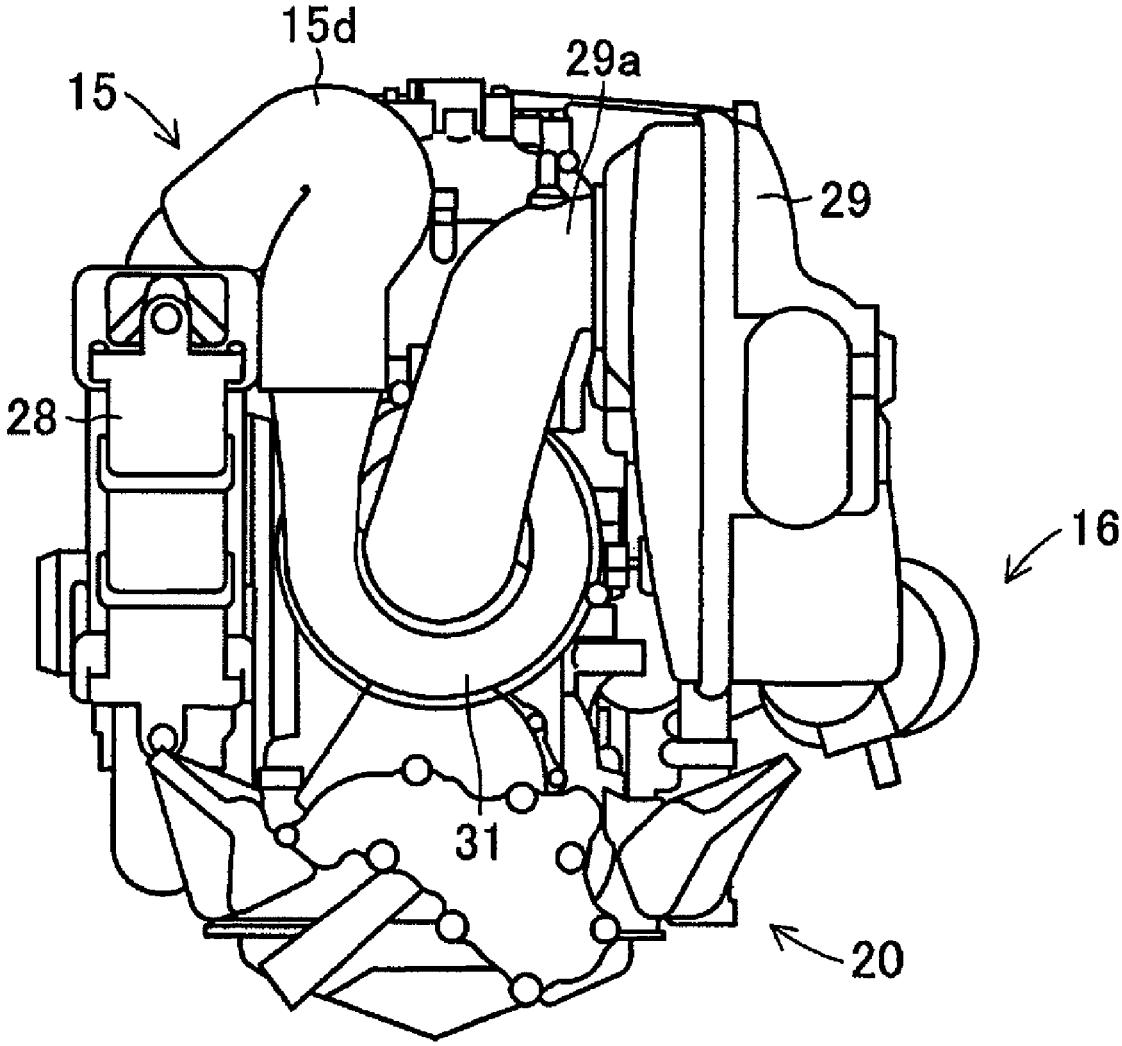
FIG. 2 is a front elevational view of the engine of the personal watercraft of FIG. 1.
Figure 4:
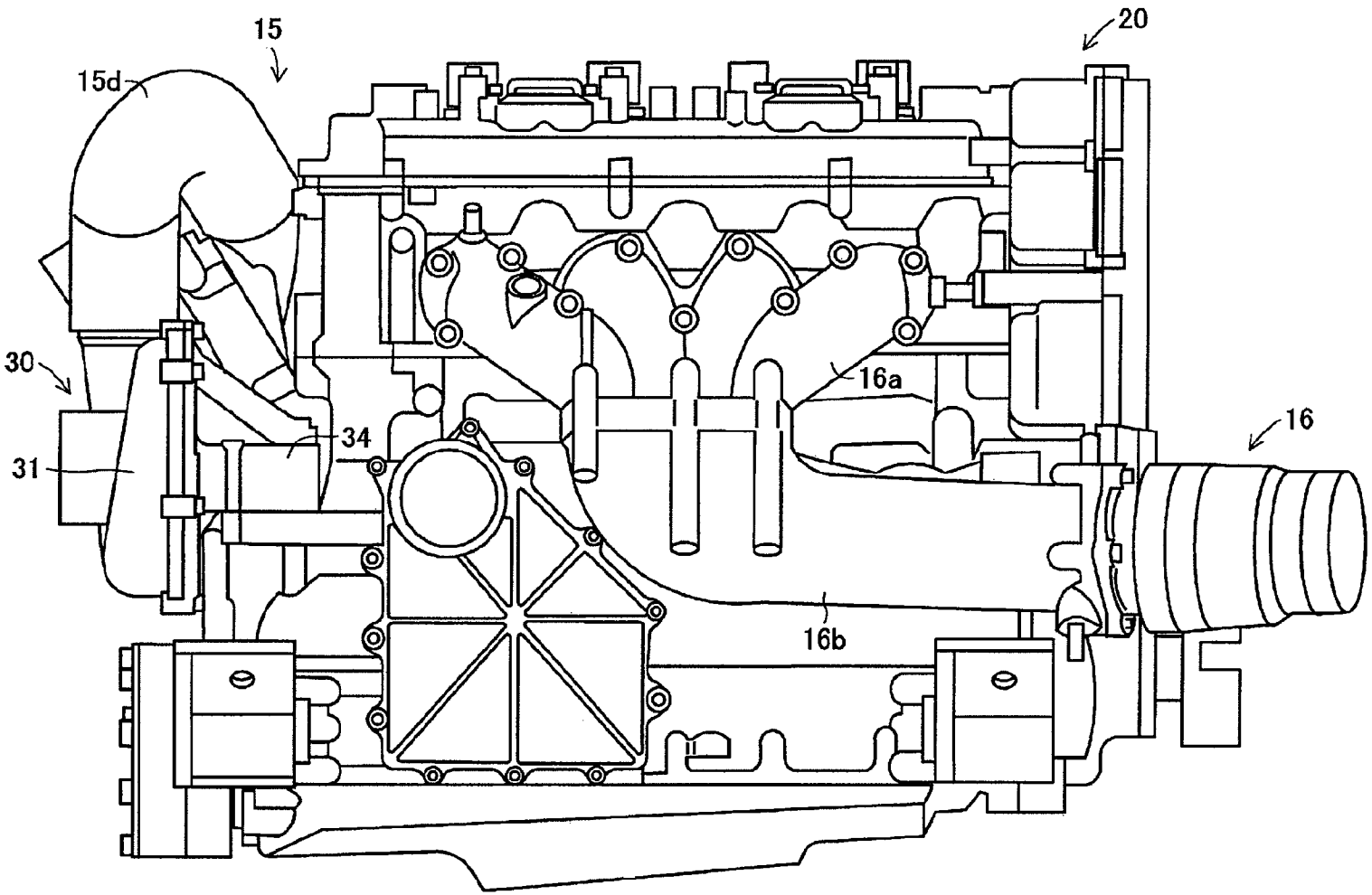
FIG. 4 is a side view of the engine of the personal watercraft of FIG. 1.

The engine compartment 13 can include an engine 20, an intake system 15, and an exhaust system 16 (see FIGS. 2 and 4). The pump compartment 14 can contain a propulsion unit 17 and other devices.

At the front and rear of the engine compartment 13, air ducts (not shown) can be provided to introduce or circulate external air into or through the engine compartment 13. These air ducts can extend vertically from the top of the body 11 to the bottom of the engine compartment 13. The air ducts can be designed to take external air from the top end through a waterproof structure (not shown) on the deck 11*a* and lead the air from the bottom end into the engine compartment 13.

A fuel tank 18 for storing fuel can be provided at the front of the engine compartment 13. The engine 20 can be provided at the bottom center of the body 11. The engine 20 and its surrounding parts can be located below the seat 12 (opening 12*a*), and can be accessed from the outside through the opening 12*a* when the seat 12 is removed. As such, the opening 12*a* can be provided above the engine 20 in the body 11 of the personal watercraft 10.

Figure 5:
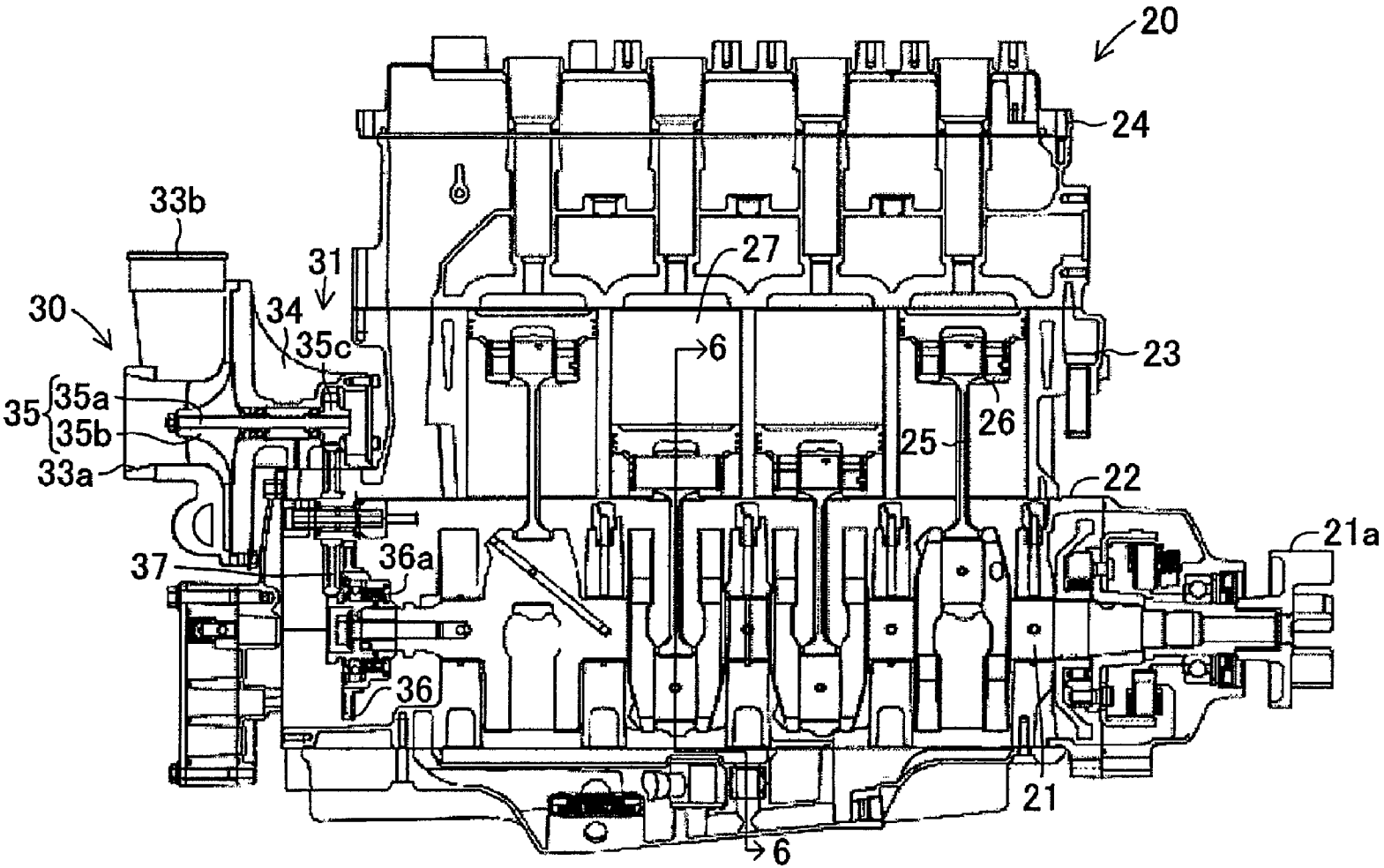
FIG. 5 is a side cross-sectional view of the engine shown in FIG. 4.
Figure 6:
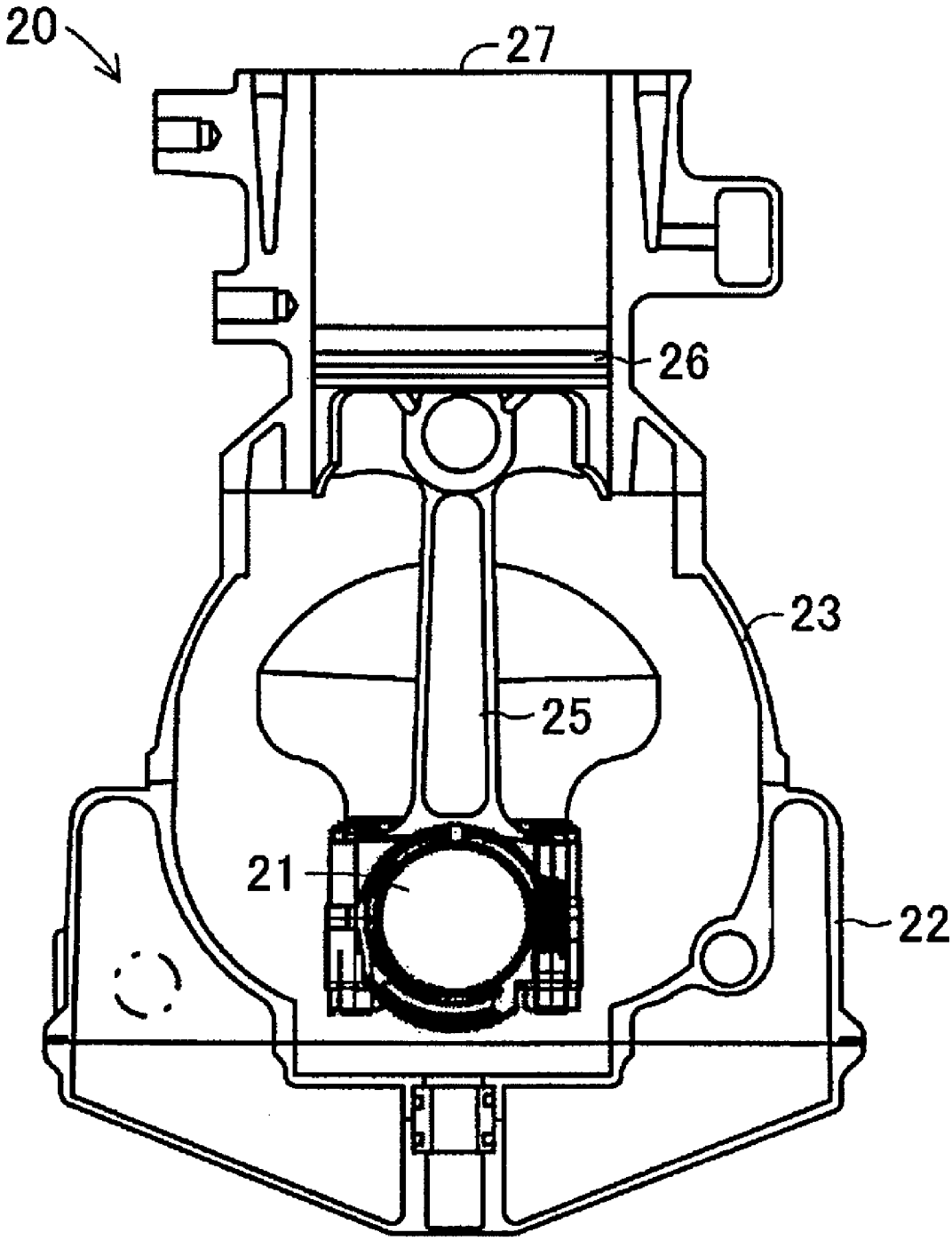
FIG. 6 is a cross-sectional view taken along the line 6-6 of FIG. 5.

The engine 20 can be a four-cycle, four-cylinder engine. As shown in FIGS. 5 and 6, a crankcase 22 can be provided which can contain a crankshaft 21, as well as a cylinder body 23 and a cylinder head 24 on the crankcase 22 which can form an outer shell of the engine body. The cylinder body 23 and the cylinder head 24 can define a cylinder. The engine 20 can be arranged such that a center axis of the cylinder extends approximately vertically such that it crosses at right angles the crankshaft 21 extending approximately horizontally.

Inside the cylinder body 23 and the cylinder head 24 are housed pistons 26 connected to the crankshaft 21 through connecting rods 25 for up and down movement. The up and down motion of the pistons 26 can be transmitted to the crankshaft 21 to produce the rotational motion of the crankshaft 21. Cylinders 27 formed in the cylinder head 24 are each provided with intake and exhaust valves (not shown).

Figure 3:
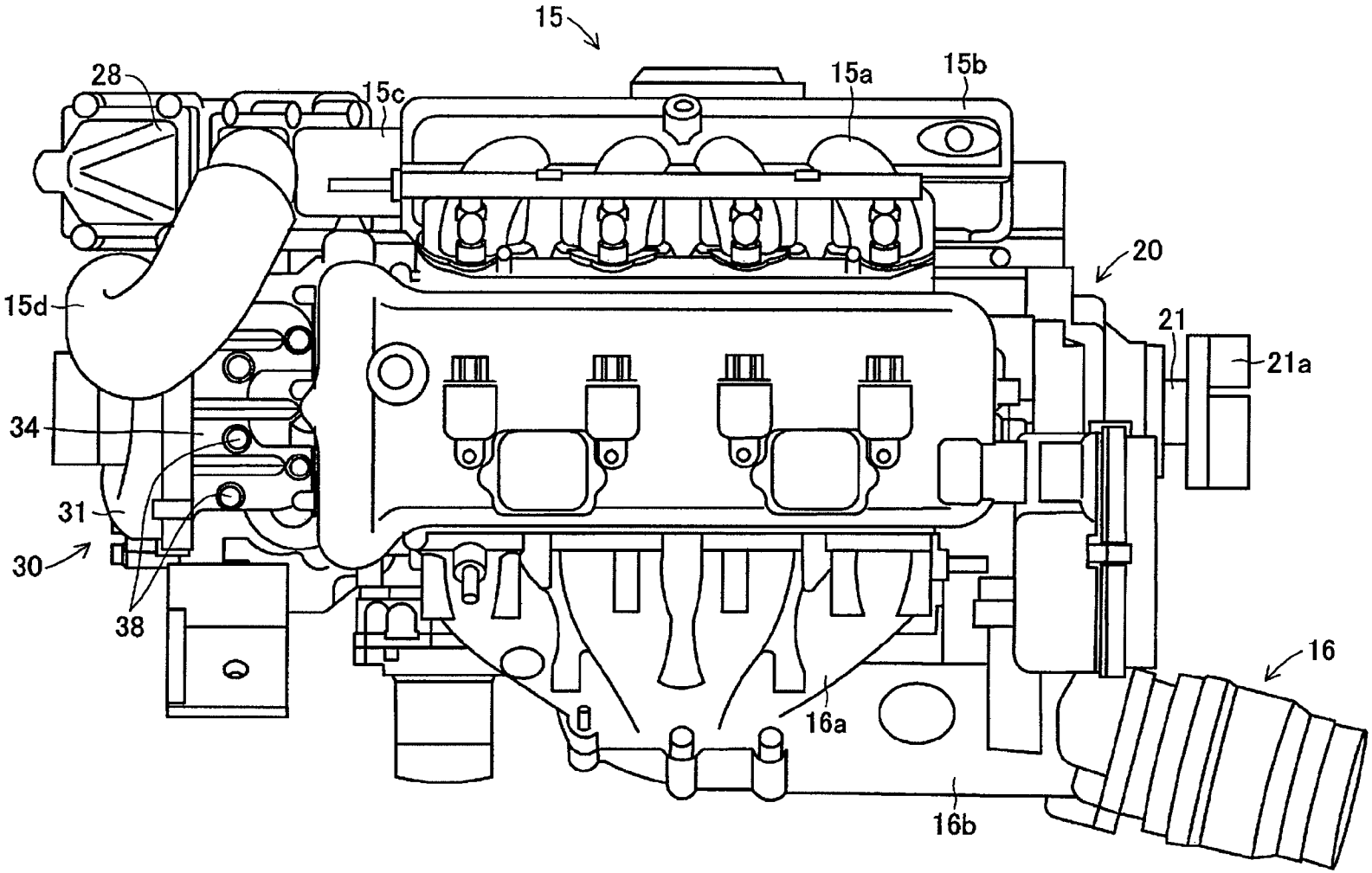
FIG. 3 is a top plan view of the engine of the personal watercraft of FIG. 1.

As shown in FIG. 3, an inlet port can be in communication with the intake valve of each cylinder 27 and be connected to the intake system 15, which can include multi-furcated intake pipes 15*a*. Similarly, an exhaust port can be in communication with the exhaust valve of each cylinder and be connected to the exhaust system 16, which can include multi-furcated exhaust pipes 16*a*.

In operation, the intake valve can open when taking air in to mix the air from the intake system 15 through the inlet port with the fuel from a fuel supply system (described in greater detail below). At the end of the intake stroke, the air-fuel mixture can be sent to each cylinder 27 for combustion and the intake valve can be closed when the combusted gas is to be discharged. The exhaust port can open to allow the combusted gas to be discharged by each cylinder 27 via the exhaust port to the exhaust system 16. Subsequently, the exhaust port can close at the end of the exhaust stroke of the piston 26.

FIGS. 2-4 show an exemplary structure and arrangement of the intake system 15 and the exhaust system 16 when connected to the engine 20. The intake system 15 can have an intake passage that includes the multi-furcated intake pipes 15*a*, a surge tank 15*b*, and air passages 15*c*, 15*d* that are in communication with a throttle body (not shown). An intercooler 28 can be placed between the air passages 15*c* and 15*d*. A compressor 31, including a supercharger, can be provided at the upstream end of the air passage 15*d*. An intake box 29 can be provided via an air passage 29*a* at the upstream end of the compressor 31. As used herein, in systems such as the intake system 15 and exhaust system 16, in which gases and liquids flow from one side to the other, the side from which the gases and liquids are provided can be referred to as the upstream end, while the side to which they are provided can be referred to as the downstream end.

The intake box 29 can be located in the area on the portside of the body 11 between the engine 20 and fuel tank 18. In some embodiments, the intake box 29 can be spaced from the engine 20. Inside of the intake box 29, an air filter (not shown) can be provided. The intake box 29 can be configured to take the air from the engine compartment 13, remove foreign substances from the air using the air filter, and then guide the air to the compressor 31 via the air passage 29*a*.

Figure 7:
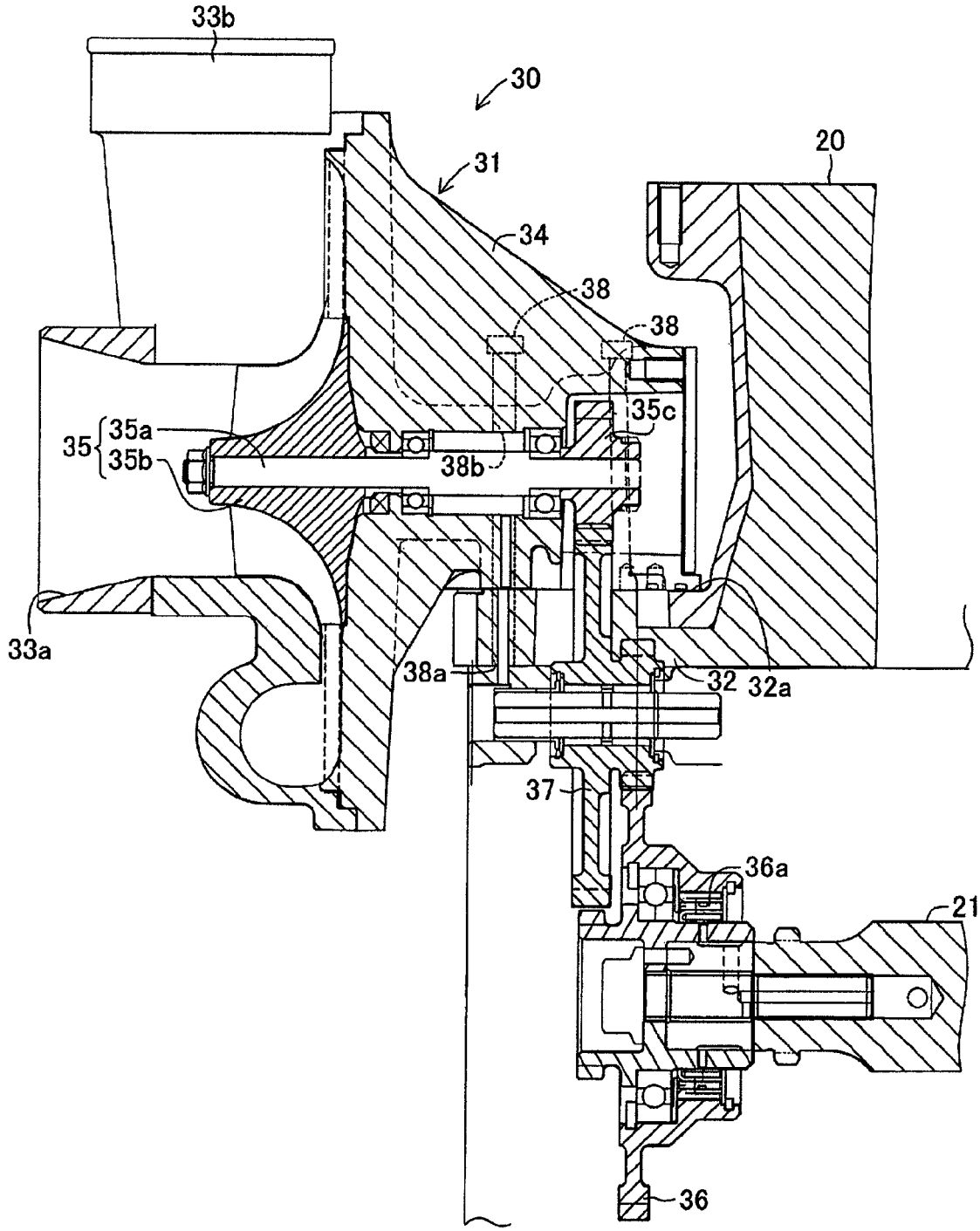
FIG. 7 is an enlarged sectional view of the compressor and a portion of the engine shown in FIG. 5.

As shown in FIG. 7, the engine 20 can be formed to include an installation structure 30. The installation structure 30 can have an installation mount 32. The compressor 31 can be provided on an upwardly facing surface 32*a* of the installation mount 32. The surface 32*a* can be provided in an area across the opening 12*a*, for example, facing toward the opening 12*a* of the engine compartment 13. The installation mount 32 can protrude forwardly from a front end of the engine 20. The installation mount 32 can extend substantially parallel to the crankshaft 21 of the engine 20. Such a configuration can ease the installation and removal of the compressor 31 for its maintenance. For example, the compressor 31 may be easily moved from the opening 12*a* toward the surface 32*a* of the installation mount 32, and thereby reduce the required space for installing the compressor 31.

The compressor 31 can also be provided with a housing 34, which can include two vents. One of the vents can be an inlet port 33*a*, which can be connected to the air passage 29*a* and can draw in the air sent from the intake box 29. The other vent can be an outlet port 33*b*, which can be connected to the air passage 15*d* and can guide the air taken in through the inlet port 33*a* to the intercooler 28.

The housing 34 can contain a rotary part 35 that can include a drive shaft 35*a* and an impeller 35*b*. The impeller 35*b* can be connected to the front end of the drive shaft 35*a* in order to be rotatable with the drive shaft 35*a*. The rotary part 35 can allow the impeller 35*b* to be mounted in the housing 34 such that the impeller 35*b* extends into the inlet port 33*a*.

According to another embodiment, the drive shaft 35*a* and the crankshaft 21 of the engine 20 can be connected via a directly-coupled gear train. The directly-coupled gear train can include at least two gears. In an embodiment, the directly-coupled gear train can include a drive gear 36. As shown in FIG. 7, a drive gear 35*c* can be installed at the rear end of the drive shaft 35*a*. The drive gear 36 can be installed at the front end of the crankshaft 21, and the drive gears 35*c* and 36 can be connected via an intermediate gear 37.

The compressor 31 can be driven by crankshaft torque, which can be transmitted via the gear train to the drive shaft

35*a* and rotary part 35. The transmission of torque to the rotary part 35 can rotate the impeller 35*b*. The rotation of the impeller 35*b* can compress the air from the air passage 29*a* to the inlet port 33*a*, and then discharge the compressed air from the outlet port 33*b* to the air passage 15*d*. In some embodiments, the drive gear 36 of the compressor can be connected to the crankshaft 21 of the engine 20, such as by direct meshing engagement to the intermediate gear 37 in the directly-coupled gear train, which can transmit driving force to the drive gear 35*c*.

In this regard, when the compressor 31 is installed on the installation mount 32, the connection of the compressor 31 to the directly-coupled gear train can ease the installation of the compressor 31. Moreover, the drive shaft 35*a* of the compressor 31 can be connected via the directly-coupled gear train to the crankshaft 21 of the engine 20, which can prevent time lag of torque transmission and excessive supercharging. Further, in such a configuration, each of the plurality of gears in the directly-coupled gear train can be smaller in order to save space. This multiplicity can also enable alternative changes of the gears and can change the performance of the compressor itself.

According to yet another embodiment, a torque fluctuation absorbing mechanism can be provided on part of a gear in the directly-coupled gear train, which can be located on the side of the crankcase 22 containing the crankshaft 21. The torque fluctuation absorbing mechanism can be configured to prevent a decrease in engine revolution at a time of sharp deceleration. The torque fluctuation mechanism can also be configured to prevent damages to the compressor 31, for example, by absorbing torque fluctuations which occur during the engine strokes (intake, compression, explosion, and exhaust).

In some embodiments, the drive gear 36 can be provided with a one-way clutch 36*a*, which can function as a torque fluctuation absorbing mechanism. If the revolution speed of the crankshaft 21 slows due to deceleration or other reason, the one-way clutch 36*a* can idle the drive gear 36, in order to prevent the compressor 31 from stopping suddenly. The one-way clutch 36 can also absorb the torque fluctuations, which occur in the engine strokes (intake, compression, power, and exhaust). The one-way clutch 36*a* can thus protect the compressor 31 and the gears in the directly-coupled gear train from being damaged.

The compressor 31 can be secured on the installation mount 32 with multiple bolts 38. The bolts 38 can be inserted through vertical screw holes 38*a*, which can be formed on the installation mount 32. The screw holes 38*a* can be oriented perpendicular relative to the surface 32*a* of the installation mount 32, and can be threaded. Insertion holes 38*b* can also be provided in the housing 34 of the compressor 31. For example, the insertion holes 38*b* can be punctured through one to another side of the housing 34. Accordingly, the installation operation can performed by aligning the compressor 31 on the installation mount 32 and then inserting the bolts 38 through the insertion holes 38*a* and into the screw holes 38*a*. Such a configuration can facilitate the installation operation.

Thus, the compressor 31 can be secured on the surface 32*a* of the installation mount 32 by screwing the bolts 38 into the screw holes 38*a* after being passed through the insertion holes 38*b*. In some embodiments, the installation structure can enable the drive gear 35*c* and intermediate gear 37 to meshingly engage with each other when the compressor is installed on the surface 32*a* of the installation mount 32.

The intercooler 28 can be provided on the slightly starboard side at the front end of the engine 20 in the body 11, which can result in juxtaposition with the compressor 31. The intercooler 28 can cool the compressed air from the compressor 31 while it passes through the air passage 15*d*.

The cooling process can increase the density of the compressed air. The compressed air can then be sent to the throttle body through the air passage 15*c*, illustrated in FIG. 3. The throttle body can include a rotary shaft and a disc-shaped throttle valve (not shown). The throttle valve can be attached to the rotary shaft such that the throttle valve can be rotatable with the rotary shaft. In operation, as the rotary shaft rotates, the throttle valve can open and close the air passage inside the throttle body to adjust the amount of air to be provided into each cylinder 27.

In other embodiments, the surge tank 15*b* can be connected to the rear end of the throttle body and can be provided at the top of the starboard side of the engine 20, as shown in the top plan view of FIG. 3. Four multi-furcated intake pipes 15*a* can extend from the side of the surge tank 15*b*. Optimally, the intake pipes 15*a* can be evenly spaced in the longitudinal direction.

Each of the multi-furcated intake pipes 15*a* can extend obliquely upward from the upstream end, which can be connected to the surge tank 15*b*. The downstream end can be connected to the inlet port of the cylinder 27. The surge tank 15*b* can prevent intake pulsation of the compressed air from the intercooler 28, and then deliver the compressed air of constant density to the multi-furcated intake pipes 15*a*.

The fuel supply system (not shown) can provide fuel from the fuel tank 18 (FIG. 1) to the engine 20 for combustion therein. The fuel supply system can include a fuel pump and a fuel injector. The fuel pump can draw fuel from the fuel tank 18 and deliver it to the fuel injector.

The fuel injector can atomize the fuel into a fine mist, which can then be injected into the cylinder 27, illustrated in FIG. 6. Simultaneously, the fuel can be mixed in the multi-furcated intake pipes 15*a* with the compressed air from the inlet box 29, for example, via the compressor 31. The air-fuel mixture can then be sent into the cylinder 27. Subsequently, an igniter in the engine 20 can activate to ignite the mixture. The resulting explosion can move the piston 26 vertically and thereby rotates the crankshaft 21 to generate torque. The torque of the crankshaft 21 can then be transmitted to the compressor 31 and propulsion unit 17.

With reference to FIGS. 3-4, the exhaust system 16 can include the multi-furcated exhaust pipes 16*a* and an exhaust pipe 16*b*. The exhaust pipes 16*a* can be connected to the exhaust port of each cylinder 27. The exhaust pipe 16*b* can be connected with the multiple pipes connected to the downstream end of the multi-furcated exhaust pipes 16*a*, a water lock (not shown) connected to the downstream end of the exhaust pipe 16*b*, etc.

In some embodiments, as shown in FIG. 4, the multi-furcated exhaust pipes 16*a* can extend obliquely downwardly from the upstream end of the pipes 16*a*, which can be connected to the exhaust ports of the cylinders 27, while the downstream ends of the pipes 16*a* can be connected to the exhaust pipe 16*b*. The exhaust pipe 16*b* can extend rearwardly along the lower part of the portside of the engine 20. The downstream end of the exhaust pipe 16*b* can be connected to the water lock.

The water lock can be a cylindrical tank of a large diameter. An exhaust gas pipe (not shown) can extend rearwardly from the rear top of the water lock. The exhaust gas pipe can extend toward the top and then in the lower rearward direction. As shown in FIG. 1, the downstream end can open to a casing 41, which can separate the propulsion unit 17 from the main frame of the body 11. The downstream end can also access outside from the rear end of the body 11.

At the rear of the engine 20, a pump drive shaft 42 can be connected to the crankshaft via a coupling 21*a*. The coupling 21*a* can extend into a pump compartment 14 behind the pump drive shaft. The pump drive shaft 42, which can be connected to an impeller (not shown) in a jet pump 17*a* at the stern of the body 11, can rotate the impeller by transmitting the torque of the crankshaft 21 driven by the engine 20. In some embodiments, the pump drive shaft 42 can be a single shaft member, or it can be made from several separate shafts connected together.

As shown in FIG. 1, the propulsion unit 17, which can include the jet pump 17*a*, can be placed at about the horizontal center of the rear end of the body 11. The propulsion unit 17 can also include a water inlet 43 open to the bottom of the body 11 and a water nozzle 44 facing toward the end of the stern. Seawater introduced from the water inlet 43 can thus be injected from the water nozzle 44 by operating the jet pump 17*a*, which can generate thrust for the body 11.

The propulsion unit 17 can be mounted to the bottom of the body 11 at the stern of the body 11 with the casing 41 separating the propulsion unit 17 from the main frame of the body 11. The pump drive shaft 42 can pass through the casing 41 and extend from the engine 20 to the jet pump 17*a* of the propulsion unit 17.

In some embodiments, a steering nozzle 45 can also be provided at the rear end of the jet pump 17*a*. The steering nozzle 45 can move the rear of the body 11 according to the steering handlebars operation in order to turn the personal watercraft 10 to the right or left. The rear of the steering nozzle 45 can also be provided with a reverse gate 46 that can move vertically to advance or reverse the personal watercraft 10. Apart from the systems described heretofore, the personal watercraft 10 can be provided with various devices for driving the vehicle. Such devices can include an electric box storing multiple components, a start switch, a variety of sensors, and/or other devices.

During operation, a driver can sit on the seat 12 and turn on the start switch, which can set the personal watercraft 10 in a standby mode. The driver can then operate the steering handlebars and a throttle operation element (not shown), which can be provided on the grip of the steering handlebars, to drive the personal watercraft 10 in a certain direction and a speed, as desired.

When stopping the personal watercraft 10, the driver can decelerate, stop the vehicle at a pier or dock, and then turn off the start switch. The driver can then open the lid of the opening 12*a* after removing the seat 12 from the body 11, and if necessary, insert their hands inside of the body 11 for maintenance, inspection, and repair of the engine 20, the compressor 31, and other parts. In order to inspect the compressor 31, the bolts 38 can be removed in order to remove the compressor 31 from the installation mount 32 of the engine 20.

In some embodiments of the installation structure 30, the opening 12*a* can be located on the deck 11*a* of the personal watercraft 10. The seat 12 can be removably mountable to the opening 12*a*. Additionally, in some embodiments, the installation mount 32 for the compressor 31 can be located at the front end of the engine 20 below the opening 12*a*. The compressor 31 can be installed on the surface 32*a* of the installation mount 32. Due to this structure, the compressor 31 can be installed by carrying the compressor 31 into the body 11 from the opening 12*a*, and then lowering the compressor 31 onto the surface 32*a* of the installation mount 32. This can ease the installation of the compressor 31 on the installation mount 32, and conserve space for installing the compressor 31. Additionally, such an orientation of the mount 32 can reduce, minimize, and/or eliminate the need to move the compressor 31 parallel to the crankshaft 21 during the installation or removal procedure.

Furthermore, the bolts 38 can be inserted downward into the insertion holes 38*b* on the housing 34, and tip ends of the bolts 38 can be screwed into the screw holes 38*a* of the installation mount 32 to secure the compressor 31 on the installation mount 32. This structure can ease the installation and removal of the compressor 31 to and from the installation mount 32 for maintenance.

Further, in such an embodiment, the drive shaft 35*a* of the compressor 31 and the crankshaft 21 of the engine 20 can be connected together, for example, by meshing engagement, via the directly-coupled gear train that can include the drive gear 35*c*, the intermediate gear 37 and the drive gear 36. This can prevent excessive supercharging, as well as the time lag of torque transmission from the crankshaft 21 to the compressor 31.

Installation of the compressor 31 on the installation mount 32 can be facilitated by the meshing engagement of the drive gear 35*c* of the compressor 31 with the intermediate gear 37. As mentioned above, the drive gear 36 can be provided with the one-way clutch 36*a*. The one-way clutch 36*a* can absorb the abrupt torque fluctuations along with the decreased engine revolutions at the time of sharp deceleration, thereby preventing the compressor 31 and the gears in the directly-coupled gear train from being damaged. The directly-coupled gear train can include the drive gear 35*c*, the intermediate gear 37, and the drive gear 36. Such a structure can enable the gears in the train to be smaller, which can also conserve space. Furthermore, this multiplicity can enable the alternative changes of the gears and easy change in performance of the compressor 31 itself.

The preferred embodiments and features of the installation structure 30 disclosed herein are not limited to the aforementioned embodiments, but may be modified as appropriate. For example, the installation structure 30 can be applied not only to personal watercraft, but to any vehicle that has an engine with a compressor, including automobiles and motorcycles. Further, in some embodiments, the directly-coupled gear train can include the drive gear 35*c*, the intermediate gear 37, and the drive gear 36. Other configurations can include and/or omit gears.

Furthermore, although the installation mount 32 can be below the opening 12*a* in some of the aforementioned embodiments, the locations of the opening and the installation mount can be anywhere, and preferably both the opening and the installation mount face each other. Additionally, although the one-way clutch 36*a* can be used as a torque fluctuation absorbing mechanism in some of the aforementioned embodiments, a rubber damper can also be used as an alternative. Thus, the arrangement and structure of the components that form the installation structure can be modified within the technical scope of the inventions described herein.

Accordingly, although the embodiments of the present inventions have been disclosed in the context of certain preferred embodiments and examples, it will be understood by those skilled in the art that the teachings herein extend beyond the specifically disclosed embodiments to other alternative embodiments and/or uses of the embodiments of the present inventions and obvious modifications and equivalents thereof.

What is claimed is:

1. A watercraft comprising:

an engine compartment including an opening;

an engine disposed in the engine compartment and accessible through the opening thereof, the engine including a crankshaft and an engine body including a front end and a rear end from which power is outputted via the crankshaft; and an installation structure mounting a compressor thereon, the installation structure including an installation mount extending outward directly from the front end of the engine body and a mounting surface mounting the compressor thereon; wherein the mounting surface extends in a direction substantially parallel to the crankshaft such that the compressor is mounted to and detached from the mounting surface in a direction substantially perpendicular to the crankshaft; and the mounting surface is arranged to face toward the opening of the engine compartment; wherein the installation structure includes a gear train arranged to couple a drive shaft of the compressor with the crankshaft, the gear train including a drive gear and an intermediate gear, the intermediate gear being arranged to mesh with the crankshaft and the drive gear to transmit a driving force from the crankshaft to the drive gear.

2. The watercraft of claim 1, wherein the engine body includes a plurality of screw holes oriented substantially perpendicular to the mounting surface, the plurality of screw holes being arranged to receive bolts to attach the compressor to the mounting surface.

3. The watercraft of claim 1, wherein the gear train includes a torque fluctuation absorbing mechanism provided on a gear in the gear train.

4. The watercraft of claim 1, wherein the gear train includes at least three gears.

5. The watercraft of claim 1, wherein the engine body includes a cylinder body arranged to at least partially house at least one cylinder of the engine, and the installation mount extends directly from the cylinder body.

6. A personal watercraft comprising:

an engine compartment including an opening;

an engine assembly including:

an engine including a crankshaft and an engine body including a front end and a rear end from which power is outputted via the crankshaft, the engine being disposed in the engine compartment and accessible through the opening of the engine compartment;

a compressor including an impeller, a housing containing the impeller, a drive shaft of the impeller, and a gear train, the gear train including a drive gear connected to the drive shaft and an intermediate gear meshed with the drive gear and the crankshaft; and an installation structure arranged to mount the compressor, the installation structure including an installation mount including a mounting surface extending outward directly from the front end of the engine body and substantially parallel to an axis of the crankshaft such that the compressor is moved in a direction substantially perpendicular to the axis of the crankshaft when mounting the compressor onto the mounting surface; wherein the mounting surface is arranged to face toward the opening of the engine compartment, the mounting surface being sized and configured to mount the compressor thereon such that the crankshaft is meshed to the drive shaft via the gear train so as to transmit a driving force from the crankshaft to the drive gear; and a plurality of screw holes are provided in the installation mount and oriented substantially perpendicular to the mounting surface, the plurality of screw holes arranged to receive bolts to attach the compressor to the mounting surface.

7. The watercraft of claim 6, wherein the gear train includes a torque fluctuation absorbing mechanism provided on a gear in the gear train.

8. The watercraft of claim 6, wherein the gear train includes at least three gears.

9. The engine of claim 6, further comprising a gear train arranged to drive the compressor, the gear train arranged between the drive shaft and the crankshaft.

10. The engine of claim 6, wherein the engine body includes a cylinder body arranged to at least partially house at least one cylinder of the engine, and the installation mount extends directly from the cylinder body.

11. An engine in combination with a personal watercraft, the engine arranged to be disposed in an engine compartment which includes an opening for accessing the engine, the engine comprising:

a crankshaft;

an engine body including a front end and a rear end from which power is outputted via the crankshaft; and an installation structure mounting a compressor thereon; wherein the installation structure includes an installation mount extending outward directly from the front end of the engine body, the installation mount including a mounting surface mounting the compressor thereon, the mounting surface extending substantially parallel to an axis of the crankshaft such that the compressor is moved in a direction substantially perpendicular to the axis of the crankshaft when mounting the compressor onto the mounting surface; and the mounting surface is arranged to face toward the opening of the engine compartment; wherein the opening of the engine compartment is arranged above the engine in a body of the personal watercraft; and the installation structure includes a gear train arranged to couple a drive shaft of the compressor to the crankshaft, the gear train including a drive gear and an intermediate gear, the intermediate gear being arranged to mesh with both the crankshaft and the drive gear to transmit a driving force from the crankshaft to the drive gear.

12. The engine of claim 11, wherein the installation mount includes a plurality of screw holes oriented substantially perpendicular to the mounting surface, the plurality of screw holes being arranged to receive bolts to attach the compressor to the mounting surface.

13. The engine of claim 11, wherein the gear train includes a torque fluctuation absorbing mechanism provided on a gear in the gear train.

14. The engine of claim 11, wherein the gear train includes at least three gears.

15. The engine of claim 11, wherein the compressor is arranged to be mounted to and detached from the mounting surface in a direction facing the opening of the engine compartment.

16. The engine of claim 11, wherein the engine body includes a cylinder body arranged to at least partially house at least one cylinder of the engine, and the installation mount extends directly from the cylinder body.

17. An engine assembly for a personal watercraft, the engine assembly comprising:

an engine including a crankshaft and an engine body, the engine body including a front end and a rear end from which power is outputted via the crankshaft, the engine arranged to be disposed in an engine compartment of the personal watercraft, the engine compartment including an opening arranged to access the engine;

a compressor including an impeller, a housing containing the impeller, a drive shaft of the impeller, and a gear train, the gear train including a drive gear connected to the drive shaft and an intermediate gear meshed with the drive gear and the crankshaft; and an installation structure arranged to mount the compressor, the installation structure including an installation mount including a mounting surface extending substantially parallel to an axis of the crankshaft such that the compressor is moved in a direction substantially perpendicular to the axis of the crankshaft when mounting the compressor onto the mounting surface; wherein the installation mount extends outward directly from the front end of the engine body with the mounting surface arranged to face toward the opening of the engine compartment;

the mounting surface is sized and arranged to mount the compressor thereon such that the crankshaft is meshed to the drive shaft via the gear train so as to transmit a driving force of the crankshaft to the drive gear; and the installation structure includes a plurality of screw holes oriented substantially perpendicular to the mounting surface, the screw holes being arranged to receive bolts to attach the compressor to the mounting surface.

18. The engine assembly of claim 17, wherein the gear train includes a torque fluctuation absorbing mechanism provided on a gear in the gear train.

19. The engine assembly of claim 17, wherein the gear train includes at least three gears.

20. The engine assembly of claim 17, wherein the compressor is arranged to be mounted to and detached from the mounting surface in a direction facing the opening of the engine compartment.

21. The engine of claim 17, wherein the engine body includes a cylinder body arranged to at least partially house at least one cylinder of the engine, and the installation mount extends directly from the cylinder body.

* * * * *